US009616496B2

(12) United States Patent
Barrett

(10) Patent No.: US 9,616,496 B2
(45) **Date of Patent: *Apr. 11, 2017**

(54) REFRACTORY COMPONENT FOR LINING A METALLURGICAL VESSEL

(71) Applicant: NORTH AMERICAN REFRACTORIES COMPANY, Moon Township, PA (US)

(72) Inventor: Ronald L. Barrett, Fenelton, PA (US)

(73) Assignee: NORTH AMERICAN REFRACTORIES COMPANY, Moon Township, PA (US)

( * ) Notice: Subject to any disclaimer, the term of this patent is extended or adjusted under 35 U.S.C. 154(b) by 23 days.

This patent is subject to a terminal disclaimer.

(21) Appl. No.: 14/886,163

(22) Filed: Oct. 19, 2015

(65) Prior Publication Data

US 2016/0039002 A1 Feb. 11, 2016

Related U.S. Application Data

(63) Continuation of application No. 14/833,232, filed on Aug. 24, 2015, which is a continuation of application No. 14/019,648, filed on Sep. 6, 2013, now Pat. No. 9,126,265.

(51) Int. Cl.

| | |
|---|---|
| ***B22D 41/02*** | (2006.01) |
| ***B22D 41/00*** | (2006.01) |
| ***B66C 1/22*** | (2006.01) |

(52) U.S. Cl.
CPC ..... *B22D 41/02* (2013.01); *B22D 41/00* (2013.01); *B66C 1/22* (2013.01)

(58) Field of Classification Search
CPC ..... B22D 41/02
USPC ..... 266/283
See application file for complete search history.

(56) References Cited

U.S. PATENT DOCUMENTS

| | | | | |
|---|---|---|---|---|
| 6,673,306 | B2 | 1/2004 | Abrino et al. | 266/275 |
| 6,787,098 | B2 | 9/2004 | Abrino et al. | 266/44 |
| 7,056,469 | B2 | 6/2006 | Nosbisch | 266/283 |
| 9,126,265 | B2 * | 9/2015 | Barrett | B22D 41/02 |
| 2015/0360915 | A1 * | 12/2015 | Barrett | B22D 41/02 294/81.54 |
| 2016/0039002 | A1 * | 2/2016 | Barrett | B22D 41/02 266/283 |

FOREIGN PATENT DOCUMENTS

| | | | |
|---|---|---|---|
| JP | H-0631435 | 2/1994 | B22D 41/02 |

* cited by examiner

*Primary Examiner* — Scott Kastler
(74) *Attorney, Agent, or Firm* — Kusner & Jaffe

(57) ABSTRACT

In a steel ladle used for handling molten steel, a precast ladle barrel ring forms part of a refractory structure that covers the bottom wall and side wall of the steel ladle. The precast ladle barrel ring is comprised of a monolithic annular ring formed of a high-temperature, cast refractory. The annular ring further includes means for positioning the precast ladle barrel ring in a steel ladle.

20 Claims, 11 Drawing Sheets

REFRACTORY COMPONENT FOR LINING A METALLURGICAL VESSEL

RELATED APPLICATIONS

The present application is a continuation of U.S. patent application Ser. No. 14/833,232, filed Aug. 24, 2015, which is a continuation of U.S. patent application Ser. No. 14/019,648, filed Sep. 6, 2013 (now U.S. Pat. No. 9,126,265, issued Sep. 8, 2015), said patent applications hereby fully incorporated herein by reference.

FIELD OF THE INVENTION

The present invention relates generally to refractory linings for metallurgical vessels and, more particularly, to a component for forming a lining for such vessels. The invention is particularly applicable for use in ladles used in handling molten steel and will be described with particular reference thereto. It will, of course, be appreciated that the present invention has application in other types of metallurgical vessels for handling molten metal.

BACKGROUND OF THE INVENTION

The handling of high-temperature liquids, such as molten steel, requires special materials and techniques. Ladles used for handling molten steel are comprised of an outer metallic shell that is lined with a refractory material. The inner surface of the metallic shell is typically lined with one or more layers of a refractory material, often brick, that can withstand extremely high temperatures and harsh, abrasive conditions. As will be appreciated, the process of laying refractory bricks within a steel ladle is very labor intensive and expensive. In this respect, workers must manually lay courses of bricks along the bottom and sides of the ladle.

Recent developments in forming pre-cast ladle bottoms have eliminated the need for workers to lay bricks on the bottom of the ladle. In this respect, U.S. Pat. Nos. 6,673,306 and 6,787,098, both to Abrino et al., disclose pre-cast ladle bottoms that can be inserted into the bottom of a steel ladle in one piece. While such a structure eliminates the need to brick the bottom of the ladle, it does not eliminate laying bricks along the sides of the ladle. Despite the problems that were solved by the use of pre-cast ladle bottoms, ladle side walls are often still constructed of brick, presenting a similar problem with respect to labor costs and the potential ergonomic issues confronted by the actual brick layers.

In this respect, the typical method of bricking the side walls around a pre-formed bottom lining involves lowering a pallet full of brick onto a bottom lining, using a crane. Once the pallet of bricks is within the ladle, laborers descend into the ladle using a ladder and proceed with laying the brick. The laborer begins laying the first course of brick at his feet and must work around the pallet of bricks within the ladle.

Moreover, the first course of bricks is often a starter set of bricks that creates a ramp such that subsequent bricks that form the lining of the side walls spiral up the walls of the ladle. Such starter bricks further require special attention to insure the proper ramp is established by the first course of bricks. Because space is restricted due to the presence of the pallet of bricks within the ladle, laying bricks creates ergonomic problems for the laborers. Even as the height of the brick increases as the side wall is constructed, the repetitive movements of taking bricks from the pallet and placing them into the side walls can cause ergonomic problems.

To date, the only solution to laying brick side walls in steel ladles has been to cast the ladle side wall. To cast a ladle side wall, a form or "mandrel" is placed into the ladle so that a space is defined between the form and the side wall of the ladle. One or more castable materials can be placed or poured between the form and the side wall to create the refractory lining. Casting ladle side walls in this manner requires the fabrication of the form or mandrel and further creates problems with respect to the poured or cast material. In this respect, controlled dry-out procedures are necessary to insure that the cast refractory lining remains intact without steam spalling. In this respect, care must be taken to insure that all water is dried out of the cast refractory lining before use. The creation of steam from residual water can create a dangerous condition when hot liquid steel flows into the ladle during use. Still further, the costs of cast refractory material that can withstand the high temperature and corrosive environment of the steel ladle are typically fairly expensive. Thus, despite the undesirable working conditions and costs, lining steel ladles with refractory bricks is still a preferred course of action.

The present invention provides a refractory component and ladle bottom and side wall structure and mitigates the ergonomic issues confronting laborers in lining a steel ladle with bricks.

SUMMARY OF THE INVENTION

In accordance with a preferred embodiment of the present invention, there is provided a precast ladle barrel ring for use in a steel ladle used for handling molten steel. The steel ladle has an outer metallic shell comprised of a bottom wall and a side wall, and further has a first layer of refractory material lining the side wall. The precast ladle barrel ring forms part of a refractory structure covering the bottom wall of the steel ladle. The refractory structure includes a bottom lining. The precast ladle barrel ring is comprised of a monolithic annular ring formed of a high-temperature, cast refractory. The ring is comprised of an annular wall defining a top surface, a bottom surface, an outer surface and an inner surface. The bottom surface is dimensioned to rest upon the bottom wall of the steel ladle or on said bottom lining. The side surface is dimensioned to be disposed adjacent to and to closely mate with the first layer of refractory brick that lines the side wall of the metal shell. The inner surface defines an opening for receiving the pre-formed bottom lining. The top surface is formed to define at least one tapered ramp. The annular ring further includes spaced-apart openings formed in the inner surface of the annular wall. The openings are dimensioned to receive lifting elements used to position the precast ladle barrel ring in the steel ladle.

In accordance with another aspect of the present invention, there is provided a refractory ring assembly for use in a steel ladle as part of a refractory structure for covering at least a portion of a side wall of a steel ladle. The ring assembly is comprised of a lower, monolithic annular ring formed of a high-temperature, cast refractory material. The lower ring is comprised of an annular wall having a bottom surface, a top surface, an inner surface and an outer surface. The bottom surface is dimensioned to rest upon the bottom wall of the steel ladle or on a pre-formed bottom lining. The top surface is a non-planar upwardly facing surface. An upper, monolithic annular ring is formed of a high-temperature, cast refractory material. The upper ring is comprised of an annular wall having a bottom surface, a top surface, an inner surface and an outer surface. The bottom surface is non-planar and is dimensioned to closely mate with the top surface of the lower ring in locking fashion. The upper surface is formed to define at least one tapered ramp. The outer surface of the upper ring is in alignment with the outer surface of the lower ring wherein the ring assembly has a smooth continuous outer surface when the upper ring and the lower ring are joined. Lifting means may be provided in the inner surface of the upper ring and inner surface of the lower ring.

An advantage of the present invention is a refractory lining for the bottom and side wall of a metallurgical vessel.

Another advantage of the present invention is a lining as described above wherein a portion of the lining is a cast refractory.

A still further advantage of the present invention is a lining as described above, the bottom of which may be constructed from pre-formed cast components.

A still further advantage of the present invention is a lining as described above wherein the pre-cast components are formed outside the ladle for insertion into the metallurgical vessel.

A still further advantage of the present invention is a lining as described above that includes a refractory lining along the sides of the metallurgical vessel.

Another advantage of the present invention is a lining as described above wherein a pre-cast ring disposed in the bottom of the ladle includes a starter ramp on the upper surface thereof to begin a spiraling course of brick along the side wall of the ladle.

A still further advantage of the present invention is a lining as described above wherein the lower portion of the lining is comprised of one or more pre-cast refractory shapes.

And yet another advantage of the present invention is a lining as described above that includes an outer annular ring for surrounding a pre-formed ladle bottom.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
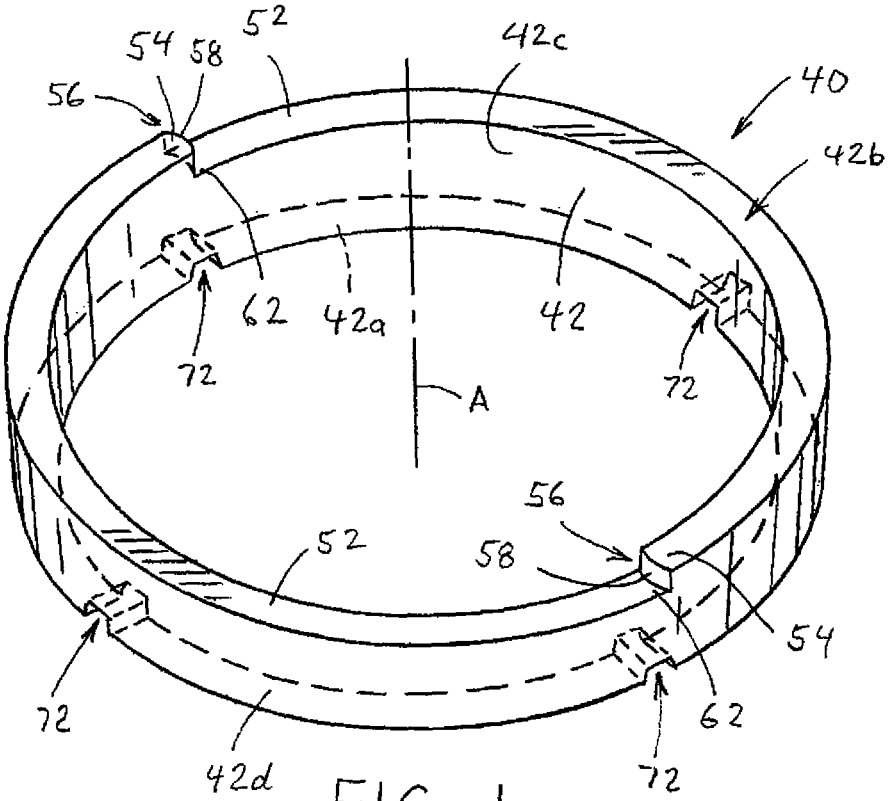
FIG. 1 is a perspective view of a precast ladle barrel ring for use in lining a steel ladle, illustrating a preferred embodiment of the present invention.

Referring now to the drawings wherein the showings are for the purpose of illustrating a preferred embodiment of the invention only and not for the purpose of limiting same, FIG. 1 shows a precast ladle barrel ring 40 for use in forming a refractory barrel lining for a metallurgical vessel. The invention is particularly applicable to a steel ladle 10, best seen in FIGS. 8-12, used in handling molten steel and will be described with particular reference thereto. However, it will be appreciated from a further reading of the specification that the invention is not limited to a steel ladle 10, but may find advantageous application for linings used in other types of metallurgical vessels handling molten metal.

FIGS. 8-12 show a conventional steel ladle 10 having an outer metallic shell 12. The outer metallic shell 12 is comprised of a cup-shaped bottom 14 and a slightly conical side wall 16. To protect metal shell 12 from molten metal, a bottom lining 22 covers or lines bottom 14 of ladle 10 and a side lining 24 covers or lines inner surface **16*a* of side wall 16 of ladle 10**.

Bottom lining 22, shall be described in greater detail below. In the embodiment shown, side lining 24 is comprised of two layers 26, 28 of refractory brick (best seen in FIG. 12) that are disposed along inner surface **16*a* of side wall 16 of ladle 10**.

Figure 8:
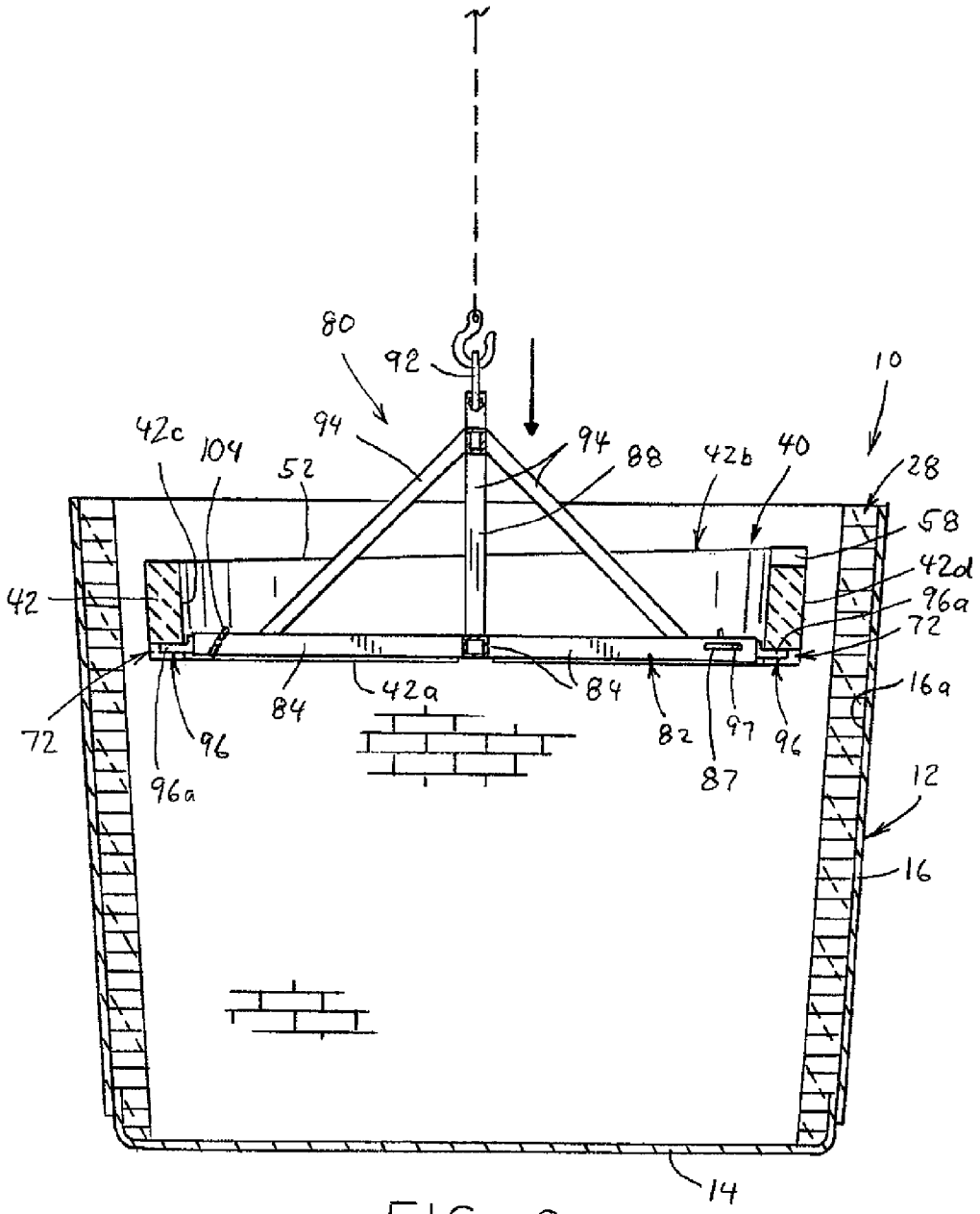
FIG. 8 is a sectional view of a steel ladle having an outer layer of refractory brick forming a permanent lining, showing a precast ladle barrel ring being placed within the ladle by the lifting device shown in FIG. 5.

FIG. 8 shows ladle 10 with outer layer 28 of refractory brick, disposed along inner surface **16*a* of side wall 16. As indicated above, outer layer 28 can be comprised of a monolithic refractory. In the drawing, outer layer 28 of refractory brick extends along the entire surface 16*a* of side wall 16 from bottom 14 to the opened upper end of ladle 10**.

Figure 12:
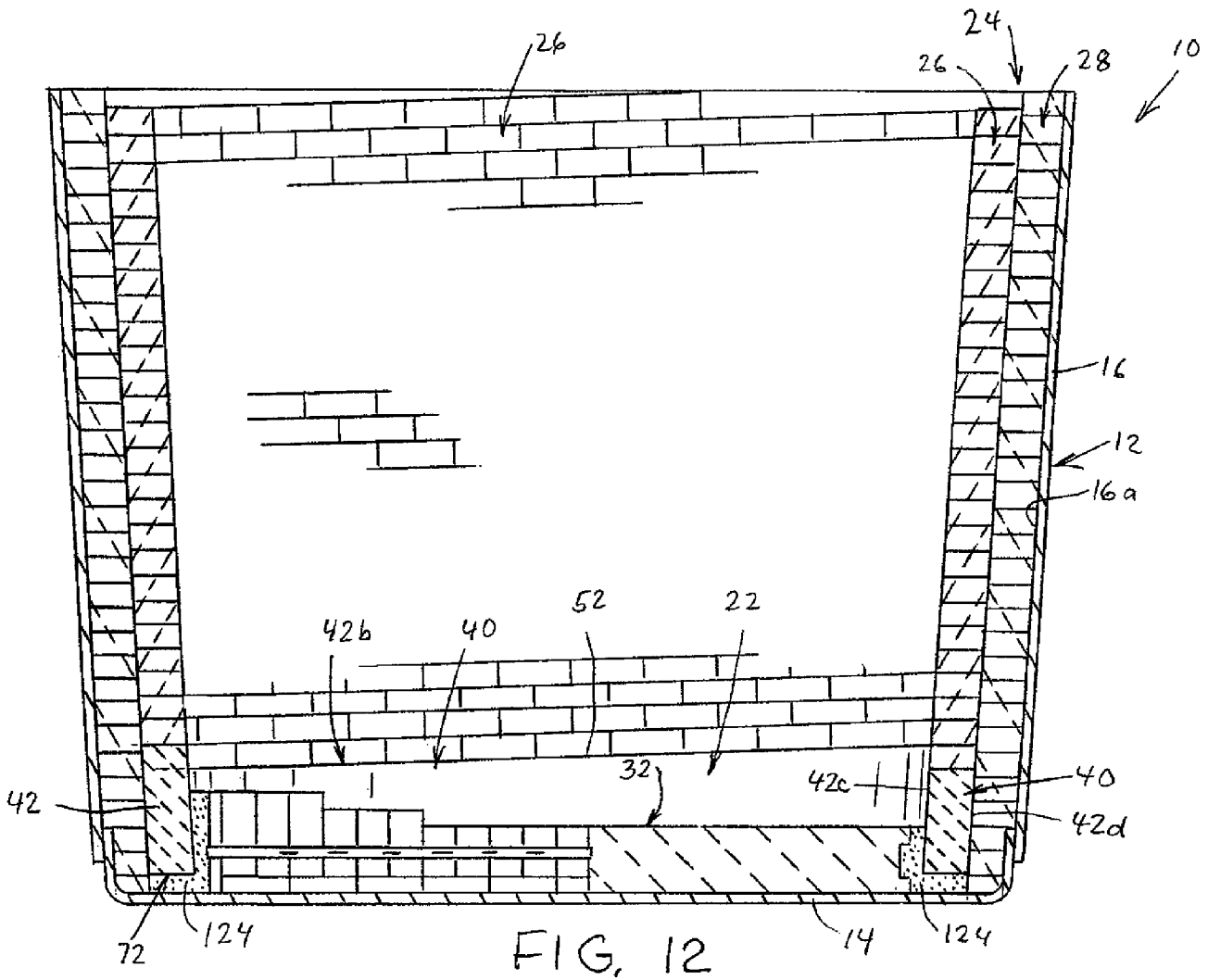
FIG. 12 is a cross-sectional view of the steel ladle shown in FIG. 8 showing an inner brick lining assembled upon the precast ladle barrel ring.

Bottom lining 22 is adapted to be disposed on bottom 14 of ladle 10 within outer layer 28 of refractory brick, as illustrated in FIG. 12. In the embodiment shown, bottom lining 22 is generally comprised of a pre-formed ladle bottom 32 and a precast ladle barrel ring 40 that surrounds ladle bottom 32.

Inner layer 26 of refractory brick is generally referred to as the "working lining," and outer layer 28 of brick, i.e., the layer of brick between working lining and side wall 16 of metallic shell 12, is typically referred to as the "backup lining" or the "permanent lining." (As will be appreciated, the "permanent lining" is not per se "permanent" and eventually needs to be replaced, but the "permanent lining" lasts significantly longer than the "working lining" that needs to be replaced more frequently).

Pre-formed ladle bottom 32 may be a monolithic refractory slab, having an impact pad embedded therein, or may be comprised of a plurality of tightly packed, high-density and high-temperature refractory bricks. Pre-formed ladle bottom 32 may be of a type disclosed in prior U.S. Pat. Nos. 6,673,306 and 6,787,098, both to Abrino et al., the disclosures of which are incorporated herein by reference.

Referring now to FIGS. 1-4, precast ladle barrel ring 40, according to one aspect of the present invention, is best seen. As noted above, precast ladle barrel ring 40 forms one part of a refractory assembly that lines bottom 14 and side wall 16 of ladle 10. Precast ladle barrel ring 40 is a pre-formed refractory component cast of a high-temperature refractory material. Precast ladle barrel ring 40 is annular in shape and is dimensioned to conform generally to the shape of bottom 14 and side wall 16 of ladle 10. As will be described in greater detail below, precast ladle barrel ring 40 is to be disposed in an annular gap or space 122 defined between the outer edges of pre-formed ladle bottom 32 and inner layer 26 of refractory brick, as illustrated in the FIG. 10. Precast ladle barrel ring 40 is slightly conical in shape and is defined by an annular wall 42. In the embodiment shown, wall 42 flares outward from the bottom thereof to conform to the conical shape of steel ladle 10. As will be appreciated, if side wall 16 of metallic shell 12 is straight, i.e., cylindrical, barrel ring 40 would be cylindrical in shape. Bottom surface 42*a* of precast ladle barrel ring 40 is generally flat and dimensioned to rest on bottom 14 of metallic shell 12 of steel ladle 10 or on a refractory sub-bottom (not shown). Upper surface 42*b* of precast ladle barrel ring 40 is formed to define one or more ramped, helical surfaces 52 (best seen in FIG. 3). Each helical surface 52 has an elevated end 54 that defines a step 56 relative to a beginning or starting point 62 of helical surface 52. In the embodiment shown, step 56 of helical surface 52 has a rounded or curved end face 58, dimensioned to mate with a curved face on a refractory brick (not shown) that will form inner layer 26 of side lining 24 of steel ladle 10. It is contemplated that the end face of helical surface 52 could also be flat. Helical surface 52 is dimensioned such that end face 58 has a height equal to the height of the refractory brick that abuts end face 58. In the embodiment shown, two opposing helical surfaces 52 are shown. Each helical surface 52 defines a ramp to start a course of refractory brick along a helical spiral, wherein each course of brick spirals up the side of ladle 10.

Figure 4:
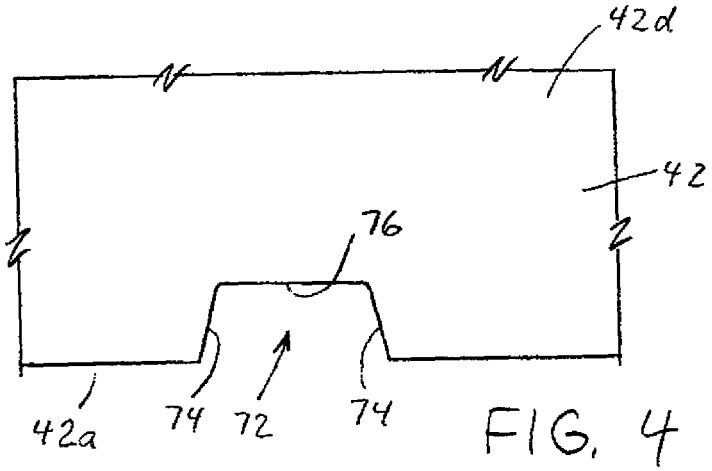
FIG. 4 is an enlarged end view of a slot in the bottom of the precast ladle barrel ring shown in FIGS. 1-3.
Figure 2:
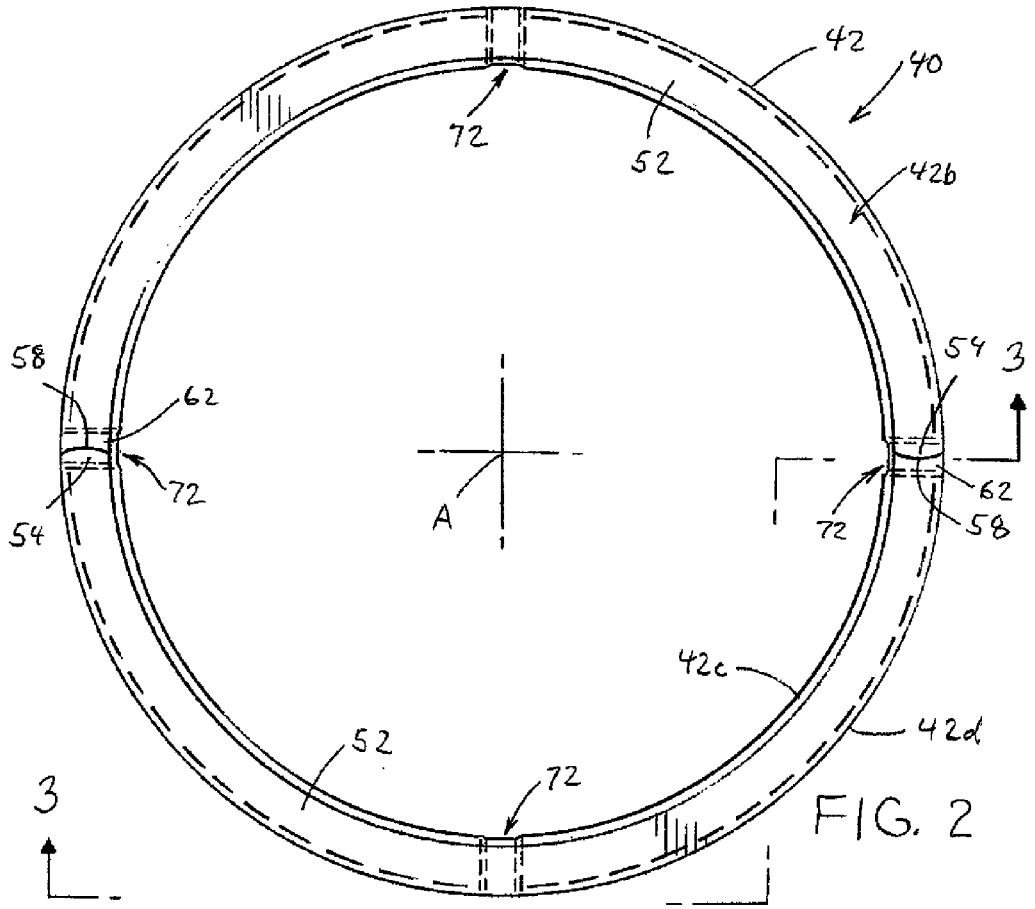
FIG. 2 is an enlarged top plan view of the precast ladle barrel ring shown in FIG. 1.
Figure 3:
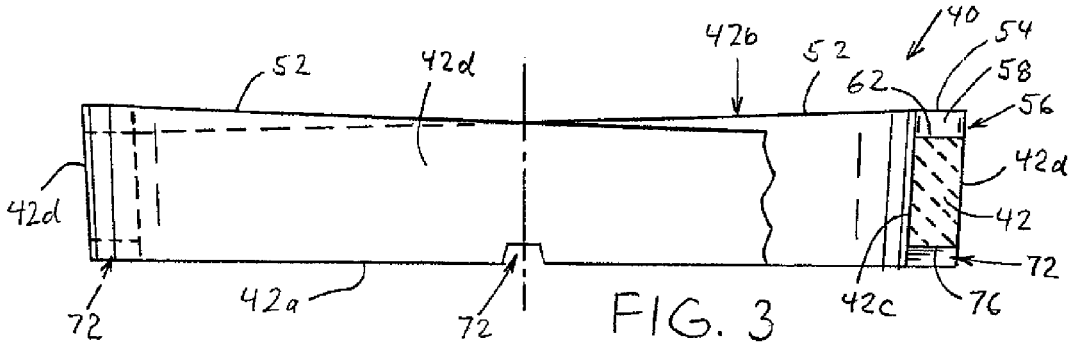
FIG. 3 is a partially-sectioned view taken along lines 3-3 of FIG. 2.

A plurality of spaced-apart slots 72 is formed in bottom surface 42*a* of precast ladle barrel ring 40. In the embodiment shown, four (4) equally-spaced slots 72 are formed in the bottom surface 42*a* of precast ladle barrel ring 40. Each slot 72 is aligned along a line radiating from a central axis "A" of precast ladle barrel ring 40, as best seen in FIG. 2. As best seen in FIG. 4, each slot 72 is trapezoidal in cross-section wherein the sides 74 of a slot 72 slope inwardly toward a top surface 76 of slot 72.

Precast ladle barrel ring 40 is preferably a monolithic structure formed of a high-temperature refractory castable, such as by way of explanation and not limitation, GREFCON®98SP sold by A.P. Green Industries, Inc. and HP-CAST®94MA-C sold by North American Refractories Co.

Figure 5:
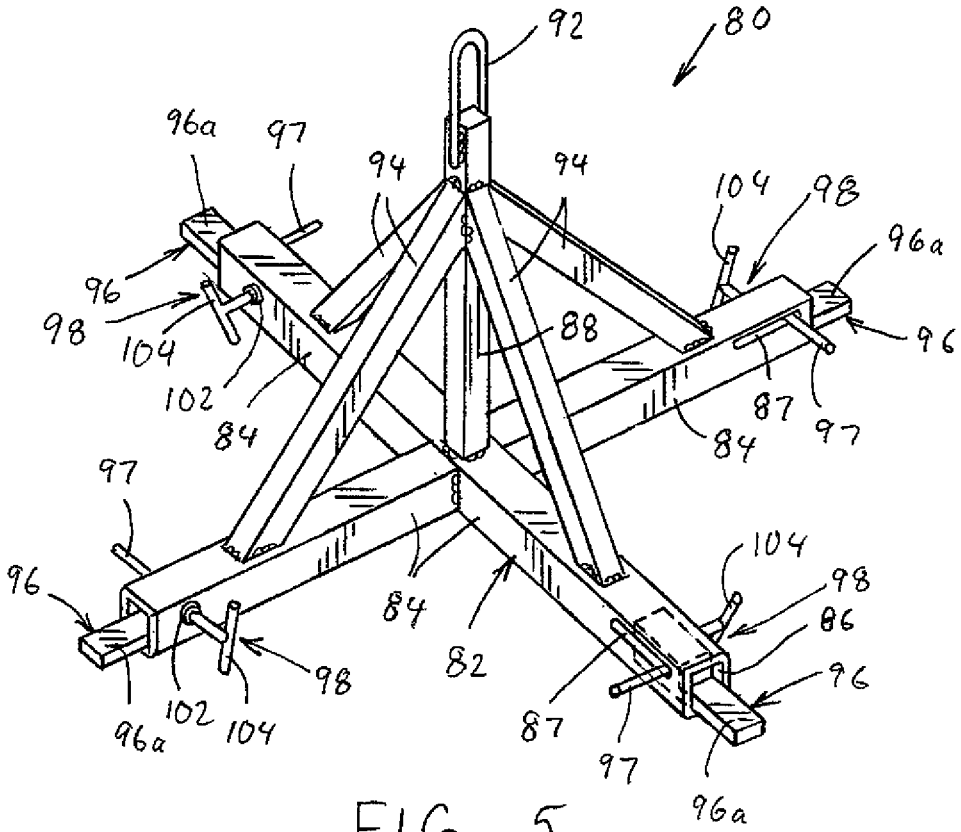
FIG. 5 is a perspective view of a lifting device for use in moving and installing the precast ladle barrel ring shown in FIG. 1.

Slots 72 in the underside of precast ladle barrel ring 40 are dimensioned to interact with a lifting device 80, best seen in FIG. 5. In the embodiment shown, lifting device 80 is comprised of a generally cross-shaped frame 82 comprised of four spaced-apart tubular legs 84. Each leg 84 is disposed at a 90° angle relative to an adjacent leg 84. In the embodiment shown, each leg 84 is comprised of a rectangular tube that defines a rectangular opening 86 therein. A central post 88 extends perpendicularly to cross-shaped frame 82. Post 88 is attached to cross-shaped frame 82 at the center of frame 82 where legs 84 are joined. A U-shaped bar 92 is attached to the upper end of post 88 to define a lifting lug, as it is conventionally known. Reinforcing arms 94 extend from post 88 to legs 84, as illustrated in FIG. 5. Frame 82 and reinforcing arms 94 are preferably formed of structural steel.

Figure 6:
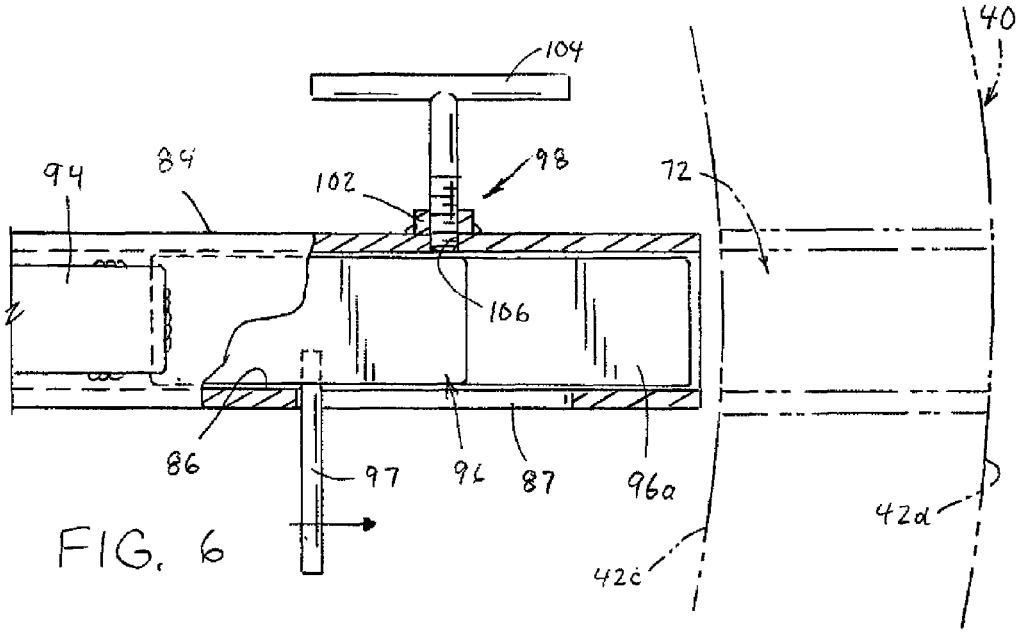
FIG. 6 is an enlarged partially-sectioned, top plan view of one leg of the lifting device shown in FIG. 5, showing a movable lifting bar in a retracted position.
Figure 7:
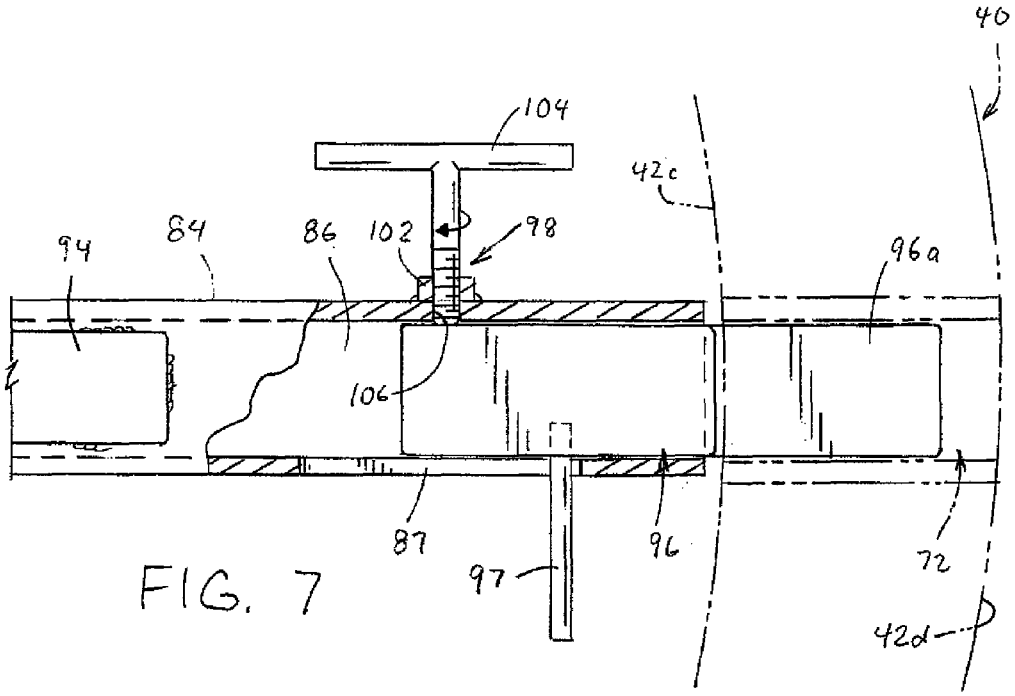
FIG. 7 is an enlarged partially-sectioned, top plan view of one leg of the lifting device shown in FIG. 5, showing the movable lifting bar in an extended position wherein the movable lifting bar is disposed within a slot in the precast ladle barrel ring shown in phantom.

Disposed within the free, outer end of each tubular leg 84 is a movable lifting bar 96, best seen in FIGS. 6 and 7. In the embodiment shown, lifting bar 96 is generally comprised of a rectangular bar dimensioned to fit within rectangular opening 86 defined by a leg 84. One end of lifting bar 96 is notched to define a plate-like section 96*a*. An elongated pin 97 extends from one side of movable lifting bar 96. Elongated pin 97 is dimensioned and positioned to extend through an elongated slot 87 formed along one side face of tubular leg 84. In this respect, lifting bar 96 is movable from a retracted position, best seen in FIG. 6, to an extended position, best seen in FIG. 7, by using pin 97 as a handle to slide lifting bar 96 within opening 86 defined by a tubular leg 84. A locking assembly 98 is provided on each leg 84 to lock lifting bar 96 in a position relative to tubular leg 84. In the embodiment shown, locking assembly 98 is comprised of a threaded fastener 102 welded to the side surface of tubular leg 84 opposite to slot 87. A threaded T-shaped bolt 104 extends through fastener 102 and through hole 106 in the side wall of tubular leg 84. The end of threaded bolt 104 is dimensioned to abut the side of lifting bar 96, wherein threaded bolt 104 can be tightened against lifting bar 96 to prevent movement of lifting bar 96 relative to tubular leg 84.

Referring now to FIGS. 8-12, a method of forming a protective refractory lining in steel ladle 10 using precast ladle barrel ring 40 is shown. As illustrated in FIG. 8, lifting device 80 is used to lift precast ladle barrel ring 40. With lifting bars 96 in each of the legs 84 moved to a retracted position, lifting device 80 can be positioned within the opening defined by precast ladle barrel ring 40. Tubular legs 84 are then aligned with slots 72 in precast ladle barrel ring 40. T-shaped bolts 104 are then unthreaded to allow movement of lifting bar 96 relative to legs 84. Each lifting bar 96 is then moved from its retracted position (shown in FIG. 6) to an extended position (shown in FIG. 7) wherein plate section 96*a* of lifting bar 96 is disposed within slot 72 formed in the underside of precast ladle barrel ring 40. With each movable lifting bar 96 moved to an extended position, lifting bar 96 is then locked into the extended position by threading T-shaped bolt 104 into engagement with movable bar 96.

Figure 9:
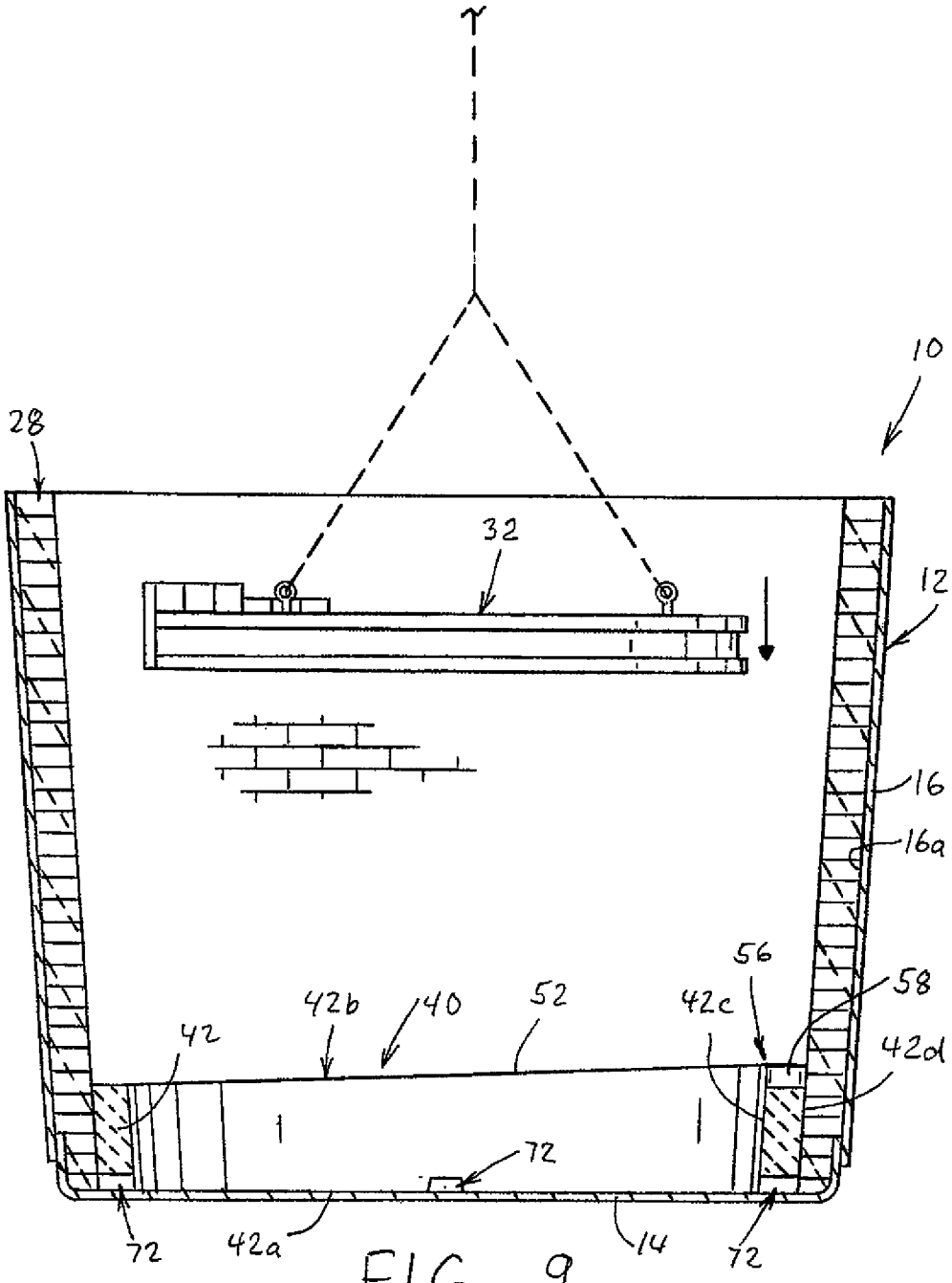
FIG. 9 is a cross-sectional view of the steel ladle shown in FIG. 8 having the precast ladle barrel ring disposed therein, showing a pre-formed bottom lining being placed within a central opening defined by the precast ladle barrel ring.
Figure 10:
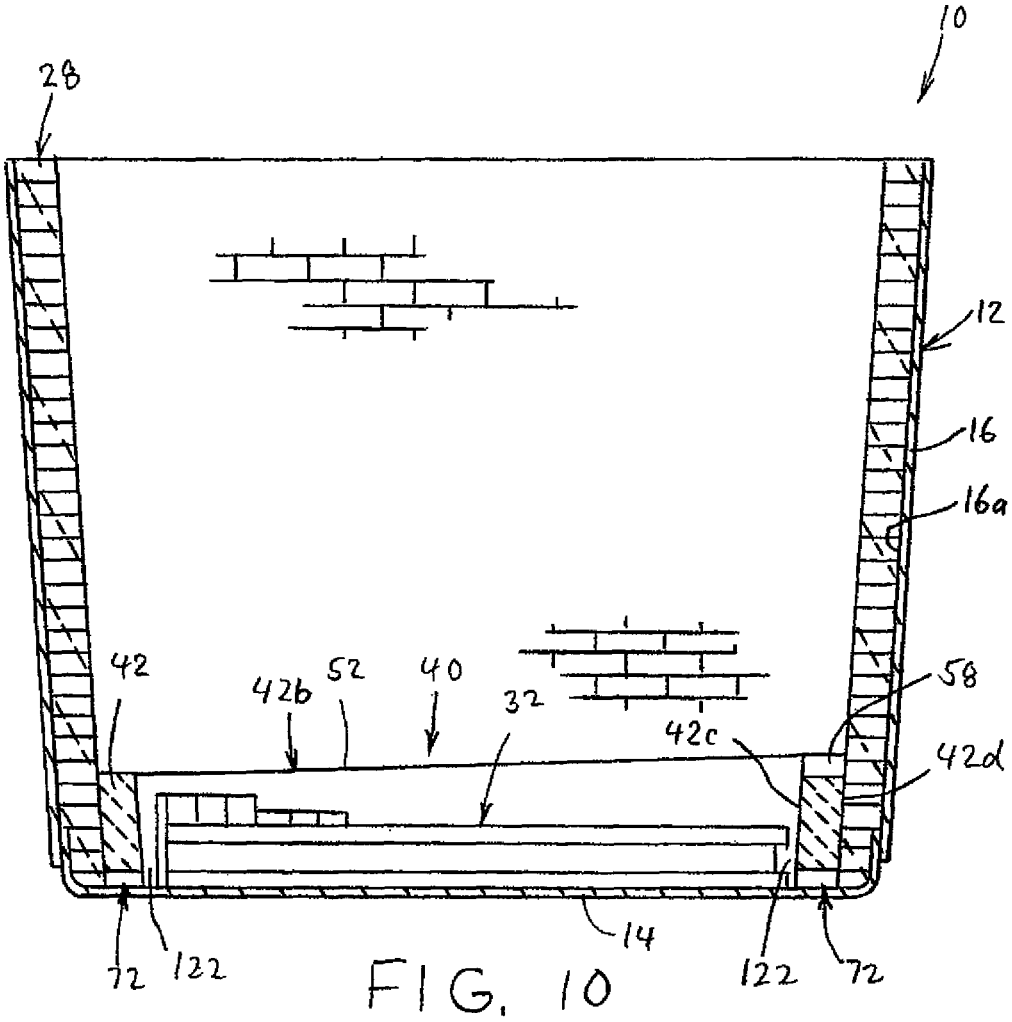
FIG. 10 is a cross-sectional view of the steel ladle shown in FIG. 8 showing the precast ladle barrel ring and the bottom lining disposed therein.
Figure 11:
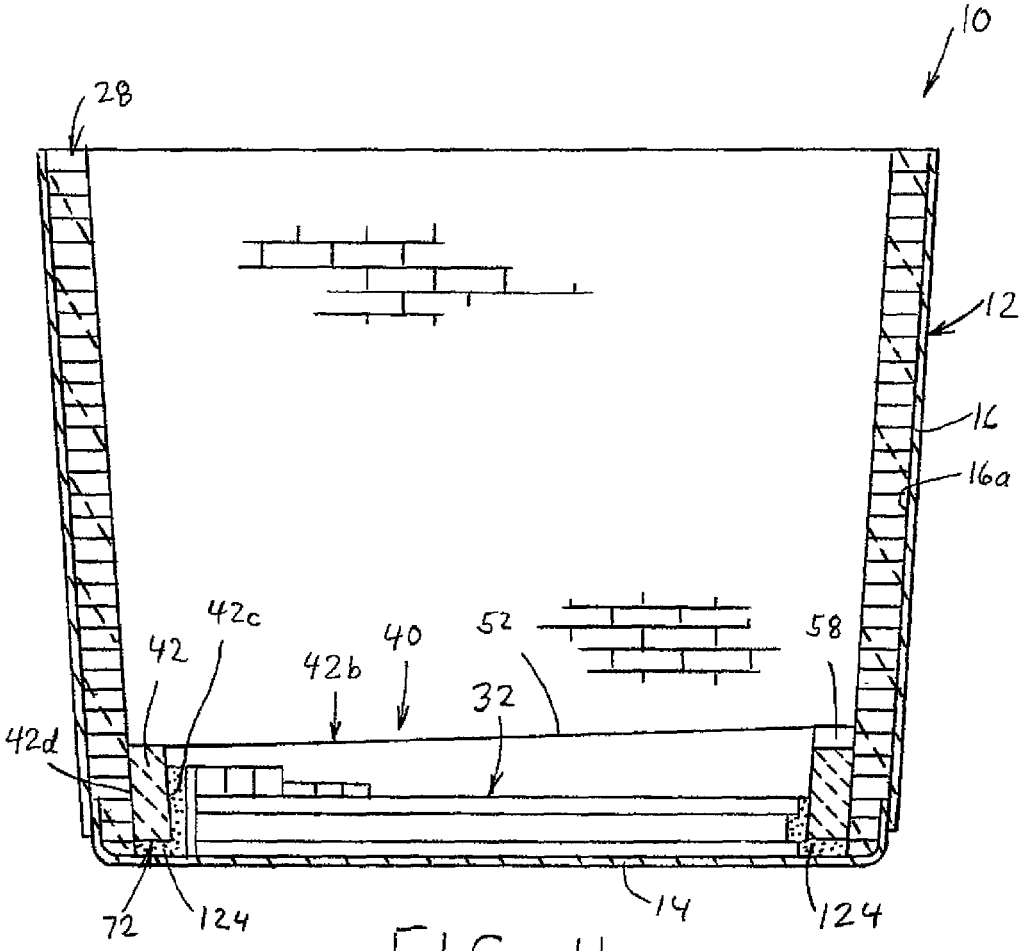
FIG. 11 is a cross-sectional view of the steel ladle shown in FIG. 8 showing a refractory material filling the gap or space defined between the outer surface of the bottom lining and the inner surface of the precast ladle barrel ring.

With lifting bars 96 of lifting device 80 extended and locked into slots 72 in the bottom of precast ladle barrel ring 40, precast ladle barrel ring 40 may be lifted by an overhead crane (not shown) and inserted into steel ladle 10, as illustrated in FIG. 8. FIG. 9 shows precast ladle barrel ring 40 positioned on bottom 14 of steel ladle 10. As illustrated in FIG. 9, precast ladle barrel ring 40 is dimensioned to closely match the opening defined by outer layer 28 of refractory brick (i.e., the permanent lining) that lines steel ladle 10. A pre-formed ladle bottom 32 is then inserted as illustrated in FIG. 9. Ladle bottom 32 is preferably of a type disclosed in U.S. Pat. No. 6,673,306 and U.S. Pat. No. 6,787,098, both to Abrino et al., the disclosures of which are expressly incorporated herein by reference. In the embodiment shown, pre-formed ladle bottom 32 is dimensioned to rest upon bottom 14 of steel ladle 10 within the opening defined by precast ladle barrel ring 40. It is also contemplated that pre-formed ladle bottom 32 could rest upon a refractory sub-bottom (not shown), as is conventionally known. As best seen in FIG. 10, the bottom lining is dimensioned to leave a space or gap 122 between the inner surface of precast ladle barrel ring 40 and the outer peripheral edge of pre-formed ladle bottom 32. Space or gap 122 is filled with a high-temperature refractory mortar or castable material 124, as illustrated in FIG. 11. As shown in FIG. 11, mortar or castable material 124, in addition to filling gap or space 122 between ladle bottom 32 and precast ladle barrel ring 40, fills slots 72 formed in the bottom of precast ladle barrel ring 40. In this respect, a refractory material, together with precast ladle barrel ring 40 and pre-formed ladle bottom 32, completely covers bottom wall 14 of steel ladle 10. Once the refractory castable has set, a pallet (not shown) of refractory brick is set onto pre-formed ladle bottom 32 and workers may climb down into ladle 10 to install spiraling courses of refractory brick against outer layer 28 (the permanent lining) using helical surfaces 52 formed on upper surface 42*b* of precast ladle barrel ring 40.

Figure 13:
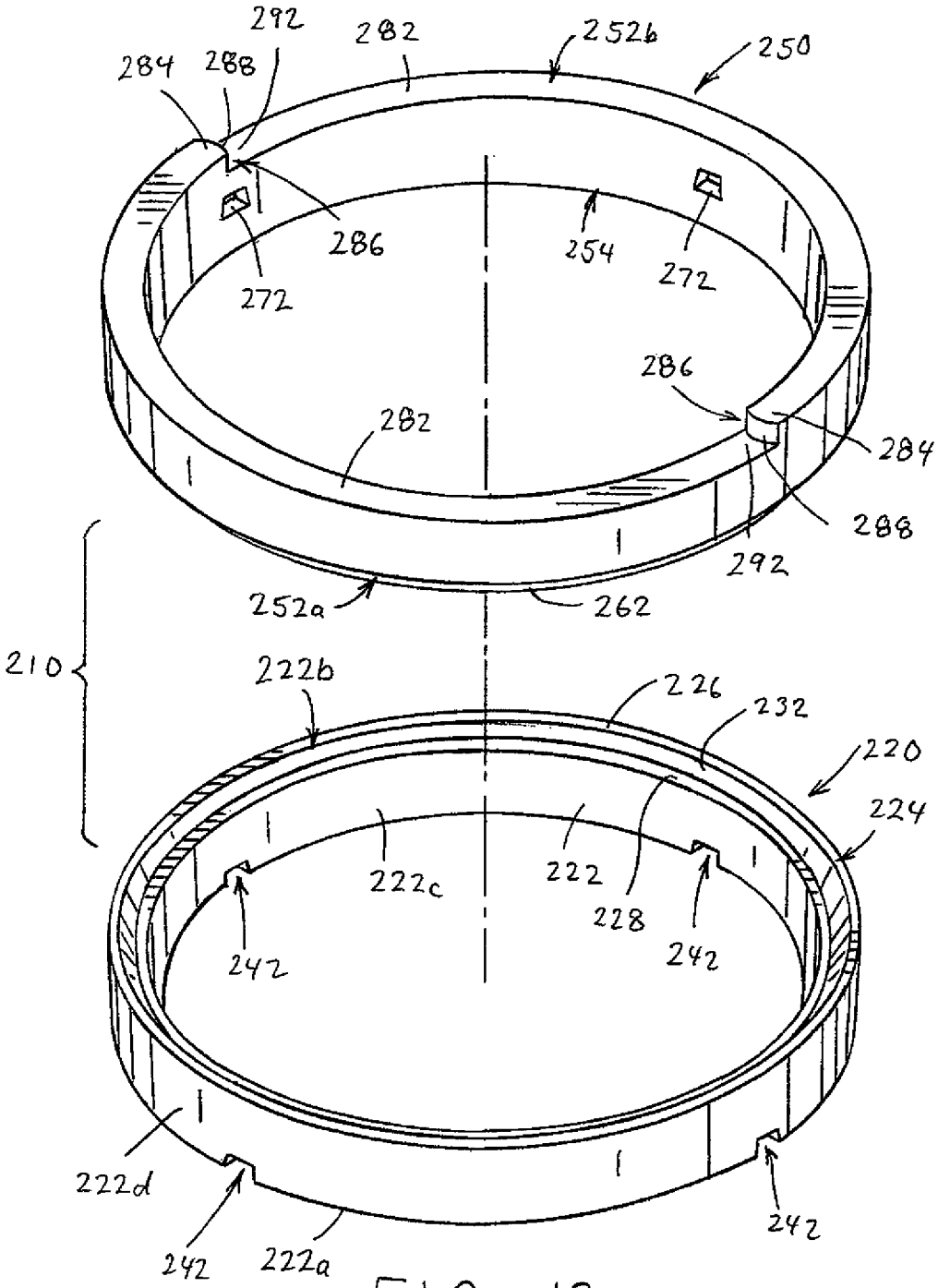
FIG. 13 is a perspective view of a multi-ring, precast ladle barrel assembly illustrating another embodiment of the present invention.
Figure 14:
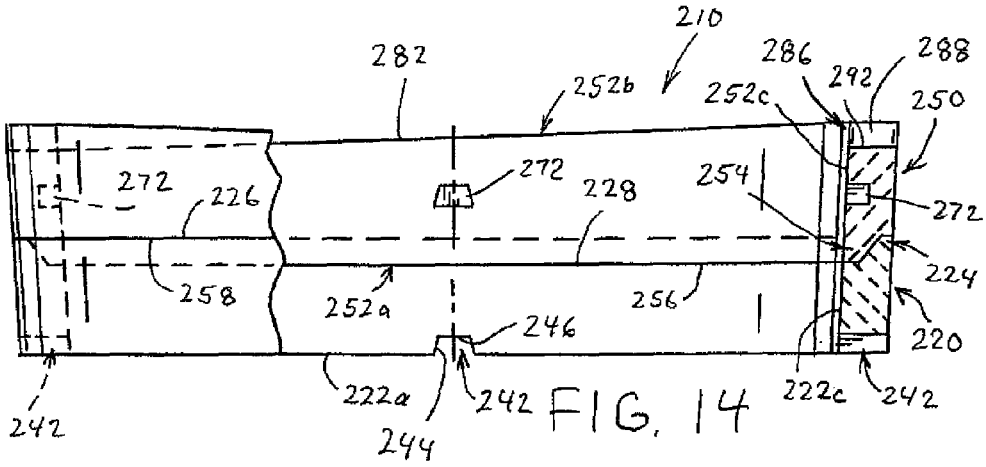
FIG. 14 is a partially-sectioned, side elevational view of the multi-ring, precast ladle barrel assembly shown in FIG. 13.
Figure 15:
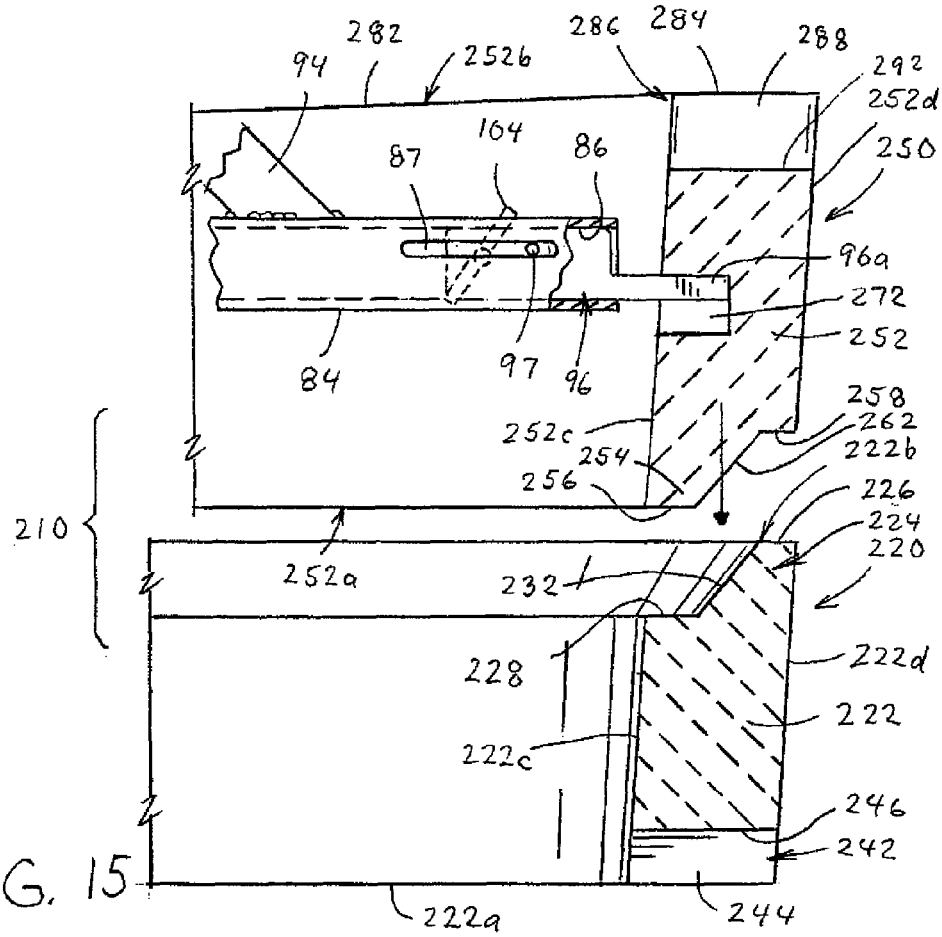
FIG. 15 is an enlarged view of a portion of the multi-ring, precast ladle barrel assembly showing an upper ring being positioned on to a lower ring by the lifting assembly (partially shown) shown in FIG. 5.

Referring now to FIGS. 13-15, a ring assembly 210, illustrating another embodiment of the present invention, is shown. Ring assembly 210 is comprised of a plurality of separate, pre-formed rings that are dimensioned to be joined together to form an interlocking structure. Ring assembly 210 includes at least a lower ring 220 and an upper ring 250. Intermediate rings (not shown) may also be provided between the lower ring and the upper ring.

Lower ring 220 is formed of a high-temperature, cast refractory material and includes an annular wall 222 having a bottom surface 222*a*, a top surface 222*b*, an inner surface 222*c* and an outer surface 222*d*. Bottom surface 222*a* is dimensioned to conform to and rest upon bottom 14 of steel ladle 10. Top surface 222*b* of lower ring 220 is formed as a mounting surface to interact with the upper ring 250, as shall be described in greater detail below. In the embodiment shown, top surface 222*b* of lower ring 220 is formed to define an outer collar 224 along the periphery of lower ring 220. Outer collar 224 defines an outer annular surface 226, an inner annular surface 228 and a joining surface 232 that connects outer annular surface 226 to inner annular surface 228. In the embodiment shown, outer annular surface 226 and inner annular surface 228 are planar surfaces that are generally parallel to each other. Joining surface 232 is generally conical in shape.

Lower ring 220 is annular in shape and is dimensioned to conform to the shape of steel ladle 10. In this respect, as indicated above, ring assembly 210 is dimensioned to be disposed within steel ladle 10 with outer surface 222*d* of ring assembly 210 disposed adjacent to outer layer 28 of brick within steel ladle 10. In this respect, outer surface 222*d* of lower ring 220 is generally conical in shape to conform to the conical shape of steel ladle 10.

A plurality of spaced-apart slots 242 is formed in bottom surface 222*a* of lower ring 220. In the embodiment shown, four (4) equally-spaced slots 242 are formed in the bottom surface of lower ring 220. Each slot 242 is aligned along a line radiating toward a central axis of lower ring 220. As with the embodiment shown in FIGS. 1-12, each slot 242 has a trapezoidal cross-section wherein sides 244 of slot 242 slope inwardly toward a top surface 246 of the slot. In other words, slots 242 define an opening in inner surface 222*c* of lower ring 220 to receive lifting bars 96 of lifting device 80 shown in FIG. 5.

Upper ring 250 is also a pre-formed refractory component cast of a high-temperature refractory material. Upper ring 250 includes an annular wall 252 having a bottom surface 252*a*, a top surface 252*b*, an inner surface 252*c* and an outer surface 252*d*. Bottom surface 252*a* is dimensioned to mate with top surface 222*b* of lower ring 220. In this respect, bottom surface 252*a* of upper ring 250 is formed to have an annular inner collar 254 that defines an inner annular surface 256, an outer annular surface 258 and a joining surface 262 therebetween. The inner and outer annular surfaces 256, 258 are generally planar surfaces and joining surface 262 is slightly conical.

As indicated above, bottom surface 252*a* of upper ring 250 is dimensioned to mate with and is seated on top surface 222*b* of lower ring 220, as illustrated in FIGS. 14 and 15. In this respect, top surface 222*b* of lower ring 220 and bottom surface 252*a* of upper ring 250 essentially define a convoluted, S-shaped path between inner surfaces 222*c*, 252*c* and outer surfaces 222*d*, 252*d* of upper and bottom rings 250, 220. In other words, the mating surfaces of lower ring 220 and upper ring 250 are non-planar.

In the embodiment shown, outer surface 252*d* of upper ring 250 is dimensioned to be in continuous alignment with outer surface 222*d* of lower ring 220 wherein ring assembly 210 has a smooth, continuous outer surface when upper ring 250 and lower ring 220 are joined, as illustrated in FIG. 14. In this respect, the outer surface of the entire ring assembly 210 is slightly conical to conform to the shape of a conventional steel ladle Inner surface 252*c* of upper ring 250 is preferably, but not necessarily, dimensioned to align with inner surface 222*c* of lower ring 220 wherein ring assembly 210 has a continuous, smooth slightly conical inner surface when lower ring 220 and upper ring 250 are joined.

A plurality of spaced-apart openings 272 is formed in inner surface 252*c* of upper ring 250 (as best seen in FIG. 15). Openings 272 define cavities or recesses in inner surface 252*c*. The cavities are dimensioned to receive plate section 96*a* of lifting bar 96 of lifting device 80, as illustrated in FIG. 15.

Top surface 252*b* of upper ring 250 is formed to define one or more ramped, helical surfaces 282 (best seen in FIG. 13). Each helical surface 282 has an elevated end 284 that defines a step 286 relative to a beginning or starting point 292 of helical surface 282. Step 286 of helical surface 282 has a rounded or curved end face 288, dimensioned to mate with a curved face on a refractory brick (not shown) that will form inner layer 26 of side lining 24 of steel ladle 10. In this respect, helical surface 282 is dimensioned such that end face 288 has a height equal to the height of the refractory brick that abuts end face 288. In the embodiment shown, two opposing helical surfaces 282 are shown. Each helical surface 282 defines a ramp to start a course of refractory brick along a helical spiral, wherein each course of brick spirals up the side of ladle 10.

FIG. 15 illustrates how the ring assembly 210 is formed.

Lower ring 220 is positioned within ladle 10 using lifting device 80, as shown in FIG. 5. As will be understood from the previous description relating to precast ladle barrel ring 40, lifting device 80 is attached to lower ring 220 by inserting movable lifting bars 96 into slots 242 on the underside of lower ring 220. Lower ring 220 is then inserted into a ladle 10 using an overhead crane or the like.

With lower ring 220 positioned within ladle 10, lifting device 80 is then attached to upper ring 250. Once lifting device 80 is connected to upper ring 250, upper ring 250 can be lowered into position onto lower ring 220 as generally illustrated in FIG. 15. Thereafter, assembly of the inner brick lining may be performed using helical surfaces 282 on top surface 252*b* of upper ring 250.

Although the ring assembly shown in FIGS. 13-15 includes only an upper ring 250 and a lower ring 220, it is contemplated that one or more intermediate rings (not shown) could be employed to increase the height of ring assembly 210. In this respect, an intermediate ring would be annular in shape and also be formed of a high-temperature, cast refractory material. The intermediate ring would have a top surface similar to top surface 222*b* of lower ring 220, and it would further have a bottom surface similar to bottom surface 252*a* of upper ring 250, wherein the intermediate ring would rest on lower ring 220 and would receive upper ring 250 thereon. The intermediate ring would also be dimensioned such that the inner and outer surfaces of the intermediate ring would conform to the dimensions of the inner and outer dimensions of lower ring 220 and upper ring 250 to provide a ring assembly 210 wherein the outer surface and the inner surface of the ring assembly are continuous and fit within steel ladle 10.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A precast ladle barrel ring for use in a steel ladle used for handling molten steel, said steel ladle having an outer metallic shell comprised of a bottom wall and a side wall, and further having a first layer of refractory material lining said side wall, said precast ladle barrel ring disposed above said bottom wall of said steel ladle, said precast ladle barrel ring comprised of:

a monolithic annular ring formed of a high-temperature refractory, said annular ring comprised of an annular wall defining
a top surface,
a bottom surface
an outer surface and
an inner surface, said bottom surface dimensioned to be disposed above said bottom wall of said steel ladle, said outer surface dimensioned to be disposed adjacent to and to closely mate with said first layer of refractory material lining said side wall of said metal shell, said inner surface defining an opening dimensioned to receive a refractory lining, and said top surface formed to define at least one tapered ramp, said annular ring further including spaced-apart openings formed in said inner surface of said annular wall.

2. A precast ladle barrel ring as defined in claim 1, wherein said annular ring is further comprised of a plurality of castable materials placed to define said surfaces of said annular wall.

3. A precast ladle barrel ring as defined in claim 1, wherein said annular ring is dimensioned to fill a space between said refractory lining and said side wall of said outer metallic shell.

4. A precast ladle barrel ring as defined in claim 1, wherein said openings are dimensioned to receive elements used to position said precast ladle barrel ring in said steel ladle.

5. A ladle barrel ring for use in a steel ladle used for handling molten steel, said steel ladle having an outer metallic shell comprised of a bottom wall, a side wall, and a first layer of refractory material lining said side wall, said ladle barrel ring disposed above said bottom wall of said steel ladle, said barrel ring comprised of:

a pre-formed annular ring defined by a plurality of high-temperature refractory components, said annular ring comprised of an annular wall defining
a top surface,
a bottom surface
an outer surface and
an inner surface, said bottom surface dimensioned to be disposed above said bottom wall of said steel ladle, said outer surface dimensioned to be disposed adjacent to and to closely mate with said first layer of refractory material lining said side wall of said metal shell, said inner surface defining an opening dimensioned to receive a refractory lining, and said top surface formed to define at least one tapered ramp, said annular ring further including spaced-apart openings formed in said inner surface of said annular wall.

6. A ladle barrel ring as defined in claim 5, wherein said openings are dimensioned to receive elements used to position said ladle barrel ring in said steel ladle.

7. A ladle barrel ring as defined in claim 5, wherein said refractory components are cast into said annular ring.

8. A ladle barrel ring as defined in claim 5, wherein said refractory components are unified to form said annular ring.

9. A ladle barrel ring as defined in claim 5, wherein said bottom surface is dimensioned to rest upon said bottom wall.

10. A ladle barrel ring as defined in claim 5, wherein said annular ring is a monolithic annular ring.

11. A ladle barrel ring as defined in claim 5, wherein said annular ring is precast with said refractory components.

12. A pre-formed ladle barrel ring for use in a steel ladle used for handling molten steel, said steel ladle having an outer metallic shell comprised of a bottom wall, a side wall, and a first layer of refractory material lining said side wall, said pre-formed ladle barrel ring disposed above said bottom wall of said steel ladle, said barrel ring comprised of:

an annular ring comprised of a plurality of high-temperature refractory materials, said annular ring comprised of an annular wall defining
a top surface,
a bottom surface
an outer surface and
an inner surface, said bottom surface dimensioned to be disposed above said bottom wall of said steel ladle, said outer surface dimensioned to be disposed adjacent to and to closely mate with said first layer of refractory material lining said side wall of said metal shell, said inner surface defining an opening dimensioned to receive a refractory lining, and said top surface formed to define at least one tapered ramp, said annular ring further including spaced-apart openings formed in said inner surface of said annular wall.

13. A pre-formed ladle barrel ring as defined in claim 12, wherein said openings are dimensioned to receive elements used to position said pre-formed ladle barrel ring in said steel ladle.

14. A pre-formed ladle barrel ring as defined in claim 13, wherein said elements are configured to lift said inner surface of said annular wall.

15. A pre-formed ladle barrel ring as defined in claim 12, wherein said materials define a high-temperature monolithic refractory.

16. A pre-formed ladle barrel ring as defined in claim 14, wherein said monolithic refractory forms said annular ring.

17. A pre-formed ladle barrel ring as defined in claim 12, wherein said materials define a unitary monolithic structure.

18. A pre-formed ladle barrel ring as defined in claim 12, wherein said refractory materials are castable.

19. A pre-formed ladle barrel ring as defined in claim 12, wherein said annular ring is dimensioned to form part of a refractory structure disposed above said bottom wall of said steel ladle.

20. A pre-formed ladle barrel ring as defined in claim 12, wherein said refractory lining is a pre-formed bottom lining.

* * * * *